US005770273A

United States Patent [19]

Offer et al.

[11] Patent Number: 5,770,273

[45] Date of Patent: Jun. 23, 1998

[54] PLASMA COATING PROCESS FOR IMPROVED BONDING OF COATINGS ON SUBSTRATES

[75] Inventors: Henry Peter Offer, Los Gatos, Calif.; Yuk-Chiu Lau, Ballston Lake; Young Jin Kim, Clifton Park, both of N.Y.; Alfred Stanley Nelson, III, San Jose, Calif.

[73] Assignee: General Electric Company, San Jose, Calif.

[21] Appl. No.: 726,908

[22] Filed: Oct. 7, 1996

Related U.S. Application Data

[63] Continuation of Ser. No. 388,081, Feb. 14, 1995, abandoned.

[51] Int. Cl.[6] ..... C23C 4/08

[52] U.S. Cl. ..... 427/455; 427/456; 427/446; 427/576

[58] Field of Search ..... 427/446, 455, 427/456, 534, 576, 309, 328

[56] References Cited

U.S. PATENT DOCUMENTS

| | | | |
|---|---|---|---|
| 2,982,845 | 5/1961 | Yenni et al. | 219/76 |
| 3,947,607 | 3/1976 | Gazzard et al. | 427/37 |
| 4,610,893 | 9/1986 | Eriksson et al. | 427/34 |
| 5,070,228 | 12/1991 | Siemers et al. | 427/534 |
| 5,357,075 | 10/1994 | Muehlberger | 219/121.47 |
| 5,380,564 | 1/1995 | Van Kuiken, Jr. et al. | 427/455 |

FOREIGN PATENT DOCUMENTS

| | | | |
|---|---|---|---|
| 852018 | 1/1977 | Belgium . | |
| 0182560 | 5/1986 | European Pat. Off. . | |
| 0223104 | 5/1987 | European Pat. Off. . | |
| 0234848 | 9/1987 | European Pat. Off. . | |
| 0450444 | 10/1991 | European Pat. Off. . | |
| 0568315 | 11/1993 | European Pat. Off. . | |
| 2230753 | 12/1974 | France . | |
| 60-35988 | 8/1985 | Japan | 427/446 |
| 63-15343 | 4/1988 | Japan | 427/455 |
| 2-200767 | 8/1990 | Japan | 427/534 |
| 869791 | 6/1961 | United Kingdom . | |
| 2228267 | 8/1990 | United Kingdom . | |
| 9400616 | 1/1994 | WIPO . | |

OTHER PUBLICATIONS

M.R. Jackson, "Production of Metallurgical Structures by Rapid Solidification Plasma Deposition", J. Metals, vol. 33, No. 11, pp. 23–27 (Nov. 1981).

E. Lugscheider et al., "Unterwasserplasmaspritzen—eine neue Verfahrensvariante", Schweissen & Schneiden, vol. 41, No. 10, pp. 547–550 (Oct. 1989).

*Primary Examiner*—Katherine A. Bareford

*Attorney, Agent, or Firm*—James E. McGinness; Dennis M. Flaherty

[57] ABSTRACT

A durable coating process which provides improved adhesive bond strength between the coating and its substrate. This process utilizes spray parameters which generate a unique plasma coating that can be applied through a liquid environment between the spray gun nozzle and the substrate to provide combined ion cleaning, etching and activation of the surface to be coated. The improved surface conditioning allows the creation of an exceptionally strong metallurgical bond at the interface between the splattered droplets of the coating material and the substrate. The improved plasma coating process utilizes a relatively short nozzle-to-work surface distance and is therefore suitable for use directly in a liquid such as water in order to keep the substrate from overheating, which may be more likely to occur if the coating were applied in a gas or vacuum environment. The resulting plasma coating is characterized by high values of adhesive bond strength which are attributable to the high-strength metallurgical bond formed between the coating and substrate.

16 Claims, 2 Drawing Sheets

PLASMA COATING PROCESS FOR IMPROVED BONDING OF COATINGS ON SUBSTRATES

This is a continuation of application Ser. No. 08/388,081 filed on Feb. 14, 1995, now abandoned.

FIELD OF THE INVENTION

This invention generally relates to thermal spray processes for applying a coating on a substrate. The invention relates specifically to thermal spray processes which are used to apply coatings which reduce the corrosion potential of nuclear reactor components exposed to high-temperature (i.e., about 150° C. or greater) water or steam.

BACKGROUND OF THE INVENTION

Some of the materials exposed to high-temperature water inside a boiling water reactor (BWR) include carbon steel, alloy steel, stainless steel, and nickel-based, cobalt-based and zirconium-based alloys. Despite careful selection and treatment of these materials for use in water reactors, stress corrosion cracking (SCC) occurs in materials exposed to high-temperature water.

In particular, SCC is known to occur in the girth welds (and heat affected zones thereof) of the core shroud in a BWR. The core shroud is a stainless steel cylinder surrounding the nuclear fuel core. As shown in FIG. 1, the core shroud 2 comprises a shroud head flange 2*a* for supporting the shroud head (not shown); a circular cylindrical upper shroud wall 2*b* having a top end welded to shroud head flange 2*a*; an annular top guide support ring 2*c* welded to the bottom end of upper shroud wall 2*b*; a circular cylindrical middle shroud wall having a top end welded to top guide support ring 2*c* and consisting of upper and lower shell sections 2*d* and 2*e*; and an annular core plate support ring 2*f* welded to the bottom end of the middle shroud wall and to the top end of a lower shroud wall 2*g*. (Some boiling water reactors have a middle shroud wall comprising three stacked shell sections joined by attachment welds.) The entire shroud is supported by a shroud support 6, which is welded to the bottom of lower shroud wall 2*g*, and by annular jet pump support plate 8, which is welded at its inner diameter to shroud support 6 and at its outer diameter to the reactor pressure vessel 4.

The material of the shroud and associated welds is austenitic stainless steel. The heat-affected zones of the shroud girth welds have residual weld stresses. Therefore, the mechanisms are present for these attachment welds to be susceptible to intergranular stress corrosion cracking (IGSCC). Stress corrosion cracking in the heat affected zone of any shroud girth seam weld diminishes the structural integrity of the shroud, which vertically and horizontally supports the core top guide and the shroud head.

As used herein, the term "stress corrosion cracking" refers to cracking propagated by static or dynamic tensile stressing in combination with a corrosive environment. The components of a BWR, including the core shroud, are subject to a variety of stresses associated with, e.g., differences in thermal expansion, the operating pressure needed for the containment of the reactor cooling water, and other sources such as residual stress from welding, cold working and other asymmetric metal treatments. In addition, water chemistry, welding, crevice geometry, heat treatment, and radiation can increase the susceptibility of metal in a component to SCC.

It is well known that SCC occurs at higher rates when oxygen is present in the reactor water in concentrations of about 5 ppb or greater. SCC is further increased in a high radiation flux where oxidizing species, such as oxygen, hydrogen peroxide, and short-lived radicals, are produced from radiolytic decomposition of the reactor water. Such oxidizing species increase the electrochemical corrosion potential (ECP) of metals. Electrochemical corrosion is caused by a flow of electrons from anodic to cathodic areas on metallic surfaces. The ECP is a measure of the kinetic tendency for corrosion phenomena to occur, and is a fundamental parameter in determining the rate of SCC.

In a BWR, the radiolysis of the primary water coolant in the reactor core causes the net decomposition of a small fraction of the water to the chemical products $H_2$, $H_2O_2$, $O_2$ and oxidizing and reducing radicals. For steady-state operating conditions, equilibrium concentrations of $O_2$, $H_2O_2$, and $H_2$ are established in both the water which is recirculated and the steam going to the turbine. This concentration of $O_2$, $H_2O_2$ and $H_2$ is oxidizing and results in conditions that can promote intergranular stress corrosion cracking (IGSCC) in the heat affected zones of the shroud girth welds and other susceptible materials of construction.

One method employed to mitigate IGSCC of susceptible material is the application of hydrogen water chemistry (HWC), whereby the oxidizing nature of the BWR environment is modified to a more reducing condition. This effect is achieved by adding dissolved hydrogen to the reactor feedwater. When the hydrogen reaches the reactor vessel, it reacts with the radiolytically formed oxidizing species on metal surfaces to reform water, thereby lowering the concentration of dissolved oxidizing species in the water in the vicinity of metal surfaces. If adequate amounts of hydrogen are injected, the ECP of metals in the water can be lowered to below a critical potential required for protection from IGSCC in high-temperature water, namely, a corrosion potential at or below a range of values of about −230 to −300 mV based on the standard hydrogen electrode (SHE) scale. IGSCC proceeds at an accelerated rate in systems in which the ECP is above the critical potential, and at a substantially lower or zero rate in systems in which the ECP is below the critical potential.

It has been shown that IGSCC of Type 304 stainless steel (containing 18–20% Cr, 8–10.5% Ni and 2% Mn), the preferred material used to fabricate BWR shrouds, can be mitigated by reducing the ECP of the stainless steel to values below −230 mV(SHE). An effective method of achieving this objective is to use HWC. However, high hydrogen additions, e.g., of about 200 ppb or greater, that may be required to reduce the ECP below the critical potential, can result in a higher radiation level in the steam-driven turbine section from incorporation of the short-lived N-16 species in the steam. Thus, recent investigations have focused on using minimum levels of hydrogen to achieve the benefits of HWC with minimum increase in the main steam radiation dose rates.

One effective approach to achieve this goal is to coat the IGSCC-susceptible alloys with palladium or other noble metal. Palladium doping has been shown to be effective in mitigating the crack growth rate in Type 304 stainless steel and other alloy. The techniques used to date for palladium coating include electroplating, electroless plating, hypervelocity oxy-fuel, plasma deposition and related high-vacuum techniques. Palladium alloying has been carried out using standard alloy preparation techniques. The most critical requirement for IGSCC protection of Type 304 stainless steel is to lower its ECP to values below the protection potential, i.e., −230 mV(SHE).

Conventional plasma spray and other arc-based thermal spray processes transfer the arc internally to the accelerating gun nozzle. The standard thermal spray process coating relies only on mechanical bonding of splattered molten particles on intentionally roughened surfaces. Because these thermal spray processes rely only on mechanical bonding of the coating to a roughened substrate, they require a high degree of controlled surface roughening before application of the coating.

SUMMARY OF THE INVENTION

The plasma coating process of the present invention does not require controlled surface roughening before application of the coating. Instead the plasma coating process of the invention utilizes the ionic surface cleaning, roughening, and heating characteristics of a plasma arc which is partially transferred to the work surface. The resulting ion tunnel enables the applied coating to form a significantly improved bond to the substrate on surfaces which are so smooth that the standard thermal spray coating would have essentially no adhesion.

In contrast to the standard thermal spray process coating which relies only on mechanical bonding of splattered molten particles on intentionally roughened surfaces, the plasma coating process of the invention relies to a large extent on a metallurgical bond between the coating and the work surface. Roughening of a plasma-coated surface enhances the overall adhesive bond strength even further, since both metallurgical and mechanical bonds are formed. The respective adhesive strengths of these metallurgical and mechanical bonds are additive. Depending on the length of the plasma ionized-gas tunnel chosen for a coating application, the metallurgical bond alone has been demonstrated to have a strength which equals or exceeds half of the combined metallurgical and mechanical strengths of a coating on a conventionally grit-blast roughened surface.

The exceptionally high bond strength produced by the plasma coating process of the invention was first observed on smooth, cold-rolled surfaces subsequently subjected to compressive and tensile bend testing, and was then quantified with standard adhesive tensile testing methods. Using a unique combination of parameter ranges for the plasma coating process, the levels of strength measured were found to be significantly higher than either conventional air plasma sprayed coatings or previous underwater plasma sprayed coatings. It was hypothesized that this observed performance was due to metallurgical bonding. This hypothesis was verified utilizing transmission electron microscopy, energy dispersive x-ray analysis and mechanical testing.

The ability of the coating to metallurgically bond to the work surface was attributed to the partially transferred arc current measured between the cathode and the work piece. The partial transfer of the arc to the substrate was attributed to the unique combination of spray parameters which collectively create the cleaning, etching and heating effects of the plasma ion tunnel. The metallurgical benefits of the plasma coating process of the invention are due to the unique plasma gun internal geometry combined with the selected powder injection and high-velocity spray parameters.

In the course of these studies, it was demonstrated that the plasma coating process of the present invention utilizing underwater plasma spray conditions would provide a superior adhesive bond strength as compared to high-velocity oxy-fuel (HVOF), on poorly prepared (inadequately roughened) surfaces. Subsequent testing independently verified that the HVOF process was only capable of generating a mechanical bond, whereas the plasma coating process of the invention was capable of generating significant levels of both metallurgical and mechanical bonding.

DETAILED DESCRIPTION OF THE PREFERRED EMBODIMENTS

Figure 1:
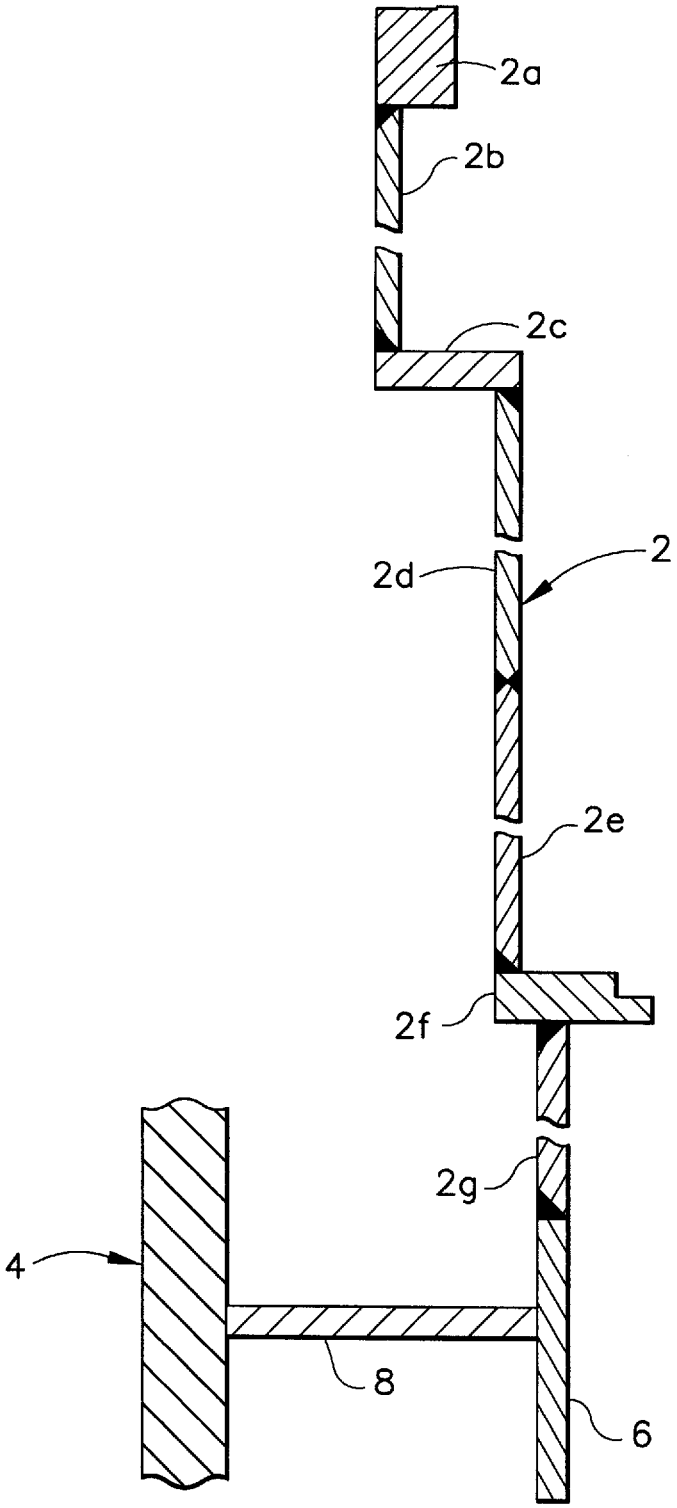
FIG. 1 is a sectional view showing the structure of a typical core shroud in a conventional BWR.
Figure 2:
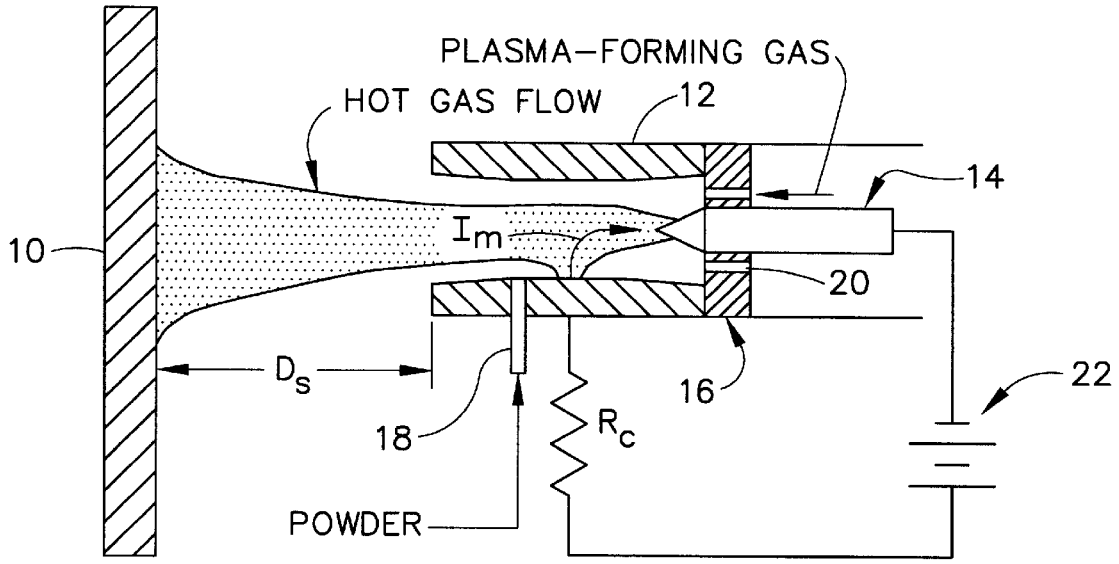
FIG. 2 is a schematic diagram showing conventional apparatus for mechanically bonding a coating to a substrate in accordance with a prior art thermal spraying technique.

In conventional variations of underwater or dry plasma spray as shown schematically in FIG. 2, the coating may be accomplished with only the reionized gas impinging on and drying the work surface. However, these methods fall short of the ion cleaning, etching, surface activation and preheating of the work surface required to achieve metallurgical bonding.

Referring to FIG. 2, a plasma gun for applying a coating on a substrate 10 using a conventional air/inert gas/vacuum plasma spray process comprises a copper anode 12 in the shape of a diverging nozzle, a copper cathode 14 arranged coaxial with the anode, and a gas diffuser 16 arranged concentric to the cathode.

A potential difference between the anode 12 and cathode 14 is maintained by a dc power supply 22. The resistance of the anode cable is indicated by resistance $R_c$ in FIG. 2. The potential difference between the anode and cathode produces a main current (i.e., arc) from the anode to the cathode indicated by $I_m$.

The gas diffuser 16 has a plurality of gas injectors 20 for injecting the plasma-forming gas into the anode. The gas injectors are distributed at equal angular intervals along a circle and open to the inner radius of the anode. The plasma-forming gas may be a gas such as argon, helium, nitrogen or mixtures thereof. As the plasma-forming gas enters the plasma gun, the plasma arc strips electrons from the atoms in the gas, thereby forming a plasma of ionized gas. The heat from the arc also raises the temperature of the injected gas. The temperature excursion is so great that the gas rapidly expands. This rapid expansion produces a very high-velocity lineal flow at the exit of the diverging nozzle. Upon emerging from the nozzle exit, the plasma gas becomes increasingly turbulent and diffuses radially outward as it flows toward the work surface.

The stream of plasma gas serves as the vehicle for the molten coating material to be applied to the substrate. One or more powder injectors 18 penetrate the anode at a point downstream of the plasma arc. Powder particles of the coating material are injected inside the anode via the powder injector in the form of a fluidized stream of particles suspended in a carrier gas. The carrier gas is preferably an inert gas. These powder particles are melted by the high-temperature plasma gas and entrained in the high-velocity plasma flow which exits the gun nozzle.

As part of the conventional air/inert gas/vacuum plasma spray process, the substrate surface is intentionally roughened, for example, by grit blasting before the coating is applied. The plasma gas carrying molten particles of coating material is aimed at the roughened surface, which is splattered with the coating material. The molten material conforms to the irregularities on the roughened surface and then cools to grip the roughened surface. The resulting coating is held on the substrate by mechanical bonding only.

In contrast, the plasma coating process of the present invention relies on a controlled-length plasma column which extends beyond the end of the spray nozzle and impinges directly on the work surface, without being unduly disturbed by the relatively high viscosity of the water or liquid, if used, through which it passes. This plasma coating process, shown schematically in FIG. 3, enables coatings to be metallurgically bonded to a significant degree, as well as mechanically bonded (if desired).

Figure 3:
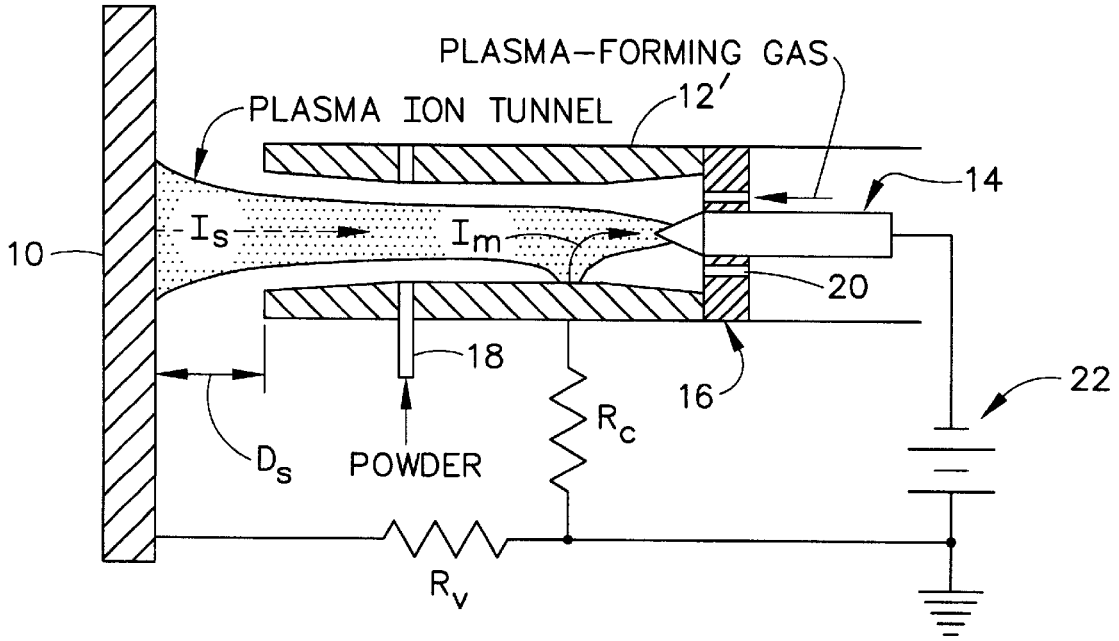
FIG. 3 is a schematic diagram showing apparatus for metallurgically bonding a coating to a substrate in accordance with a preferred embodiment of the present invention.

Referring to FIG. 3, the plasma gun has a copper anode 12' lined on its inner circumference with tungsten and a cathode 14 tipped with tungsten. A plurality of powder injectors 18 (e.g., four) are arranged at equal angular intervals along the circumference of the anode. The gas diffusion ring 16 has eight gas injectors 20 which inject the plasma-forming gas with a laminar flow. In addition, the work 10 is connected via a cable having resistance $R_v$ to the same ground (earth) that the dc power supply is connected to. This sets up a potential difference between the work and the cathode.

The metallurgical bonding of the plasma coating process of the invention is achieved by cleaning the substrate surface at the same time as the coating is being applied. The substrate surface is cleaned by heating the surface with high-velocity plasma stream at high temperature. The plasma stream is maintained in a tight tunnel by providing laminar gas flow and by shortening the spray distance $D_s$ so that the plasma stream impinges on the substrate surface. In addition, the gas mixture and the gas flow rate are adjusted to achieve the required high velocity at the nozzle exit. The impinging plasma stream transforms atoms on the substrate surface into ions, which ions leave the surface under the influence of the potential difference between the substrate and the cathode. This establishes a significant transferred current from the work piece to the cathode, indicated by $I_s$ in FIG. 3. To maintain the transferred current, positive ions such as those produced in an oxide film on the substrate surface are leaving the surface while the surface is being cleaned etched and activated. This ion etching of the work surface leaves no opportunity for new oxides to form on the substrate surface.

While the surface is being cleaned, etched, activated and pre-heated by plasma stream impingement and transferred current activation, the substrate surface is also being splattered with molten droplets of coating material. This is accomplished by injecting powder particles into the anode as part of a fluidized stream. The velocity of the carrier gas is selected to ensure that the powder particles do not overshoot or undershoot the centerline of the nozzle by a significant amount. The goal is to inject the powder particles so that a tight column is formed in the center of the plasma flow. The laminar flow inside the plasma tunnel makes it more difficult for steam, produced on the periphery of the plasma, to mix radially inward with the plasma. Furthermore, the shortened spray distance $D_s$, e.g., equal to about ½ inch for underwater plasma coating, gives oxygen atoms less time in which to reach the molten droplets in the powder column, thereby mitigating contamination of the powder column with steam. Thus, the molten particles of coating material entrained in the plasma gas flow are less susceptible to the formation of oxide skin thereon.

In summary, the present invention provides a mechanism for metallurgical bonding of the coating to the substrate by removing oxides from the substrate surface and preventing the formation of oxides on the substrate surface as molten droplets of coating material impinge thereon. The absence of oxide at the coating/substrate interface produces a coating with high adhesive bonding.

The significant degree of metallurgical bonding provided by the plasma coating process of the invention has been repeatedly demonstrated on highly diamond-polished surfaces as well as on very smooth surfaces of uncleaned, cold-rolled stainless steel sheet stock. Both of these types of surfaces are incapable of mechanical bonding, and would result in near-zero bond strength when coated with all other thermal spray processes. Metallurgical bonding has also been observed similarly on surfaces which have been cleaned using only an abrasive-impregnated rotary nylon brush, which results in essentially no roughening as compared to the thermal spray industry's typical surface cleaning and roughening condition obtained by abrasive grit blasting.

The improved strength of these metallurgically bonded coatings when applied on either uncleaned or unroughened surfaces was first determined by severe bend testing of coated samples, and has subsequently been verified using standard adhesive tensile testing, also known as bond strength testing. The existence of the metallurgical bond has been verified by observation of crystallographic continuity between the coating particles and the substrate surface interface using transmission electron microscopy. Energy dispersive x-ray analysis has verified that distinct diffusive concentration gradients of the elements Fe and Ni exist across the interface, rather than a discrete discontinuity as would exist without a metallurgical bond. This method of detecting the presence of a metallurgical bond is effective due to the significantly different levels of Fe and Ni in the coating and substrate alloys tested. The high degree of cleanliness at the splattered coating particle/substrate interface, which is a prerequisite for metallurgical bonding, was initially observed using optical microscopy, and was verified by high-magnification scanning electron microscopy of the interface. Also, the high degree of cleanliness on the coating particles being sprayed results from a combination of the relative freedom from contamination in the central portion of the plasma ion tunnel, as well as the powder injection method of the plasma coating process of the invention which ensures that the powder path to the work is necessarily through this clean central portion.

For water pressures ranging from 1 to 35 psi (equivalent to 2–80 feet of water depth), the plasma coating process has been shown to be effective in producing coatings which readily exceed the typical adhesive tensile strength and coating microstructural quality of those produced in the normal air environment. This has been demonstrated for a variety of coating compositions, including Types 308L and 309L stainless steel and Types 82, 600, 625, and 690 Inconel, all applied to Type 304 stainless steel substrates. Based on the fundamental mechanisms of the process, it is believed the improved properties of a coating produced by the process of the invention can be readily achieved for any alloy combination that can be successfully sprayed by conventional thermal spray processes.

A key observation made during the conception and development of the plasma coating process of the invention was that a significant fraction of the plasma electrical current was not passed across the arc within the torch from the cathode to the anode as normally occurs, but was transferred to the work surface. Verification of the existence of the plasma gas tunnel, rather than just a hot inert gas column, which bridges the gap through the water (or other medium) between the torch nozzle and the work surface, was made by measuring the current distribution flowing between the cathode and the anode, or between the cathode and the work. The current flowing to the work was found to be a strong function of the plasma gas tunnel length, and became negligible at lengths in excess of those at which high bond strengths were achieved.

Due to the extremely short spray distance employed in the plasma coating process of the invention, the plasma temperatures are several factors to an order of magnitude higher than the melting temperature of most metallic substrates. The plasma coating process of the invention utilizes a relatively fast torch forward travel speed (1 inch/sec or greater) and a specified plasma gas tunnel length (spray distance range) and plasma velocity through the water in order not to thermally damage or inadvertently melt the substrate. The plasma gas mixture was chosen to consist of a high total plasma gas flow rate (100 SLPM or greater) and an extremely high ratio of helium to argon (1:1 or greater), relative to all known thermal spray work, in order to maintain the plasma ion tunnel at the work surface, without increasing the arc current and the corresponding electron heating and potential for thermal damage to this surface. The high plasma gas flow rate also reduces the axial temperature and velocity gradients in the plasma gas tunnel, thereby improving the tolerance of the process to inadvertent changes in the tunnel length that may occur in typical field applications over undulating surface contours.

As an additional benefit, the metallurgical quality of the coatings produced by the inventive process are better than those produced by the conventional air plasma spray (APS) process (sprayed in an atmospheric environment). Due to the fact that the plasma gas tunnel of the invention is designed to extend from the spray nozzle completely to and impinge upon the work surface, only the approximately cylindrical interface between the plasma gas tunnel and the water becomes contaminated with water vapor, and the central portion remains as a high-purity inert gas. When the powder is properly injected into the centerline of the plasma gas tunnel, the powder can then be melted and accelerated to the work with greatly reduced oxidization by the water vapor. The central portion of the plasma is not only the cleanest but also the hottest and fastest part, which enables the powder to fully soften/melt, splatter completely, and form a coating with improved cleanliness and higher density. The resulting microstructure is superior in bond strength, oxide content and porosity content compared to that of an APS coating, or to any other underwater thermal spray coating.

Proper injection of the powder fully into the centerline of the plasma gas tunnel was consistently achievable only when a laminar rather than turbulent type of plasma gas distribution ring was used within the torch. The laminar type was very successfully used despite the guidelines of some standard plasma spray practices, which erroneously hold that laminar flow will lead to excessive anode wear rates. The excellent low anode wear rates observed were due to the preferred use of the extraordinarily high helium flow rate which maintains sufficient plasma ion tunnel diameter, length and temperature, without resorting to use of the effective but relatively high anode-damaging arc current, or to the use of an explosive/reactive gas such as hydrogen, as are commonly practiced in the thermal spray industry.

Table I shows adhesive tensile strength test results for thermal spray coating on diamond polished, nylon brushed substrate and water jet-roughened surfaces applied underwater using the plasma coating process of the present invention. All samples were fabricated from 1.00-inch-diameter Type 304 stainless steel bar, and were machined to a 16 to 32 RMS surface finish before polishing/brushing/roughening. The diamond polished samples were finished with a 0.5-micron metallographic polishing paste to a 1 to 2 RMS finish, and the nylon brushed samples were cleaned with a rotary power brush to an 8 to 16 RMS finish, to prevent a mechanical bond. The water jet (ultra high pressure) roughened samples were eroded to a 250 to 350 RMS finish, to ensure achievement of a high mechanical bond strength. All samples were sprayed underwater with Inconel 82 using the plasma coating process of the invention in 33 psi combined gas and water pressure, arbitrarily simulating a total water depth of 75 ft.

TABLE I

| Sample Number | Work Piece Surface Finishing Condition | Adhesive Tensile Strength, psi |
|---|---|---|
| 662iv-2P | Diamond Wheel Polished | 3,464 |
| 715sv-4P | Diamond Wheel Polished | 5,478 |
| 715sv-5P | Diamond Wheel Polished | 5,350 |
| 736iv-3P | Diamond Wheel Polished | 6,649 |
| 736iv-4P | Diamond Wheel Polished | 7,465 |
| 634iv-3NB | Nylon Brush Cleaned | 3,516 |
| 634iv-4NB | Nylon Brush Cleaned | 3,464 |
| 690iv-1NB | Nylon Brush Cleaned | 5,783 |
| 690iv-2NB | Nylon Brush Cleaned | 5,478 |
| 690iv-3NB | Nylon Brush Cleaned | 4,943 |
| #5-B | Water Jet Roughened | 11,360 |
| #5-C | Water Jet Roughened | 10,690 |
| #5-E | Water Jet Roughened | 10,040 |
| #6-B | Water Jet Roughened | 11,740 |
| #6-D | Water Jet Roughened | 11,240 |
| #6-E | Water Jet Roughened | 10,960 |
| #7-B | Water Jet Roughened | 10,650 |
| #7-C | Water Jet Roughened | 10,750 |
| #7-D | Water Jet Roughened | 10,890 |
| #8-A | Water Jet Roughened | 11,200 |
| #8-C | Water Jet Roughened | 10,350 |

It should be clarified that the plasma coating process of the invention is not to be confused with the optional reverse polarity plasma cleaning step of the vacuum/inert plasma spray process. This separate cleaning step is applied before the coating step, and requires a reversal in the electrical polarity of the arc, and is commonly called reverse polarity cleaning. The arc is generated between separate external electrodes (which are typically attached to the end of the anode) and the work surface. To maintain this arc, a different power supply from the main plasma spray unit is used. In contrast, in the plasma coating process of the invention, the plasma ion cleaning and coating are one and the same step, both of which are applied with the same straight polarity arc. This method of cleaning is preferred from economic, productivity and technical standpoints since the simultaneously cleaned and coated surface can remain metallurgically clean, without the need for the spray environment to be a vacuum or an inert atmosphere in order that the cleaned surface remain uncontaminated until the coating is completed.

The plasma coating process of the invention is foreseen as a practical way to accomplish the following improvements, either individually or collectively:

1) apply coatings on components that are preferably coated while submerged for reasons other than to facilitate the coating process itself;
2) provide a significantly improved coating bond composite strength on conventionally prepared (mechanically roughened) work surfaces;
3) provide coatings on intentionally smooth or inadequately/improperly prepared surfaces, yielding durably bonded coatings, which may otherwise have metallurgical surface damage (due to mechanical roughening) or unserviceably weak bonding;
4) provide coating microstructural quality that generally exceeds that produced by the standard air plasma spray process, including improved density and reduced inclusion content;

5) apply coatings without the use of a "bond coat" between the desired coating and the substrate, in applications which would otherwise leave inadequate adhesive strength;

6) reduce thermally induced metallurgical damage and detrimental tensile residual stress to surfaces which would alternatively be protected with a weld cladding or other tensile stress-inducing process.

The plasma coating process of the invention has been evaluated for use in shallow to deep water, which provides the technical benefit of significantly cooling the substrate. This function is important for the normal deposition sequence which requires multiple passes to complete the coating width and thickness, which in a gas environment leads to a heat buildup and subsequent damage to the work piece microstructure and/or increased residual stress levels. However, on large or massive components such as exist in reactor pressure vessels, the heat buildup for the plasma coating process of the invention (utilizing the plasma ion cleaning, etching, and preheating capabilities), if properly applied in air or an inert gas environment, would be insignificant. Sufficient time would be available between adjacent bead and/or subsequent layer passes so that the substrate temperature buildup can easily be controlled to an acceptable level. Other obvious changes to the spray gun, such as a longer nozzle to allow sufficient time for acceleration and heating of the powder (in order to compensate for the reduction in high plasma density as exists under pressure) may exist and will be application specific. The alternate gas environment for application of the plasma coating process of the invention may be at atmospheric pressure, under partial vacuum or in a hyperbaric environment. The gas composition may be altered to suit various purposes, although to maintain metallurgical cleanliness of the coating, an inert gas is generally preferred. The preferred spray distance in air is 4–6 inches.

Another variation of the plasma coating process is with nonmetallic coatings on metallic substrate surfaces, or with the inverse combination. This variation may also be applied with blends of metallic and non-metallic coating powders which would form composite powder splats or intermetallic phases to improve the metallurgical bond. In these applications, diffusion of the interface atoms should occur sufficiently to obtain a relatively thin crystallographic transition zone between the lattice structures of the coating and of the substrate.

The level of strength of the metallurgical bond in this variation would depend on the chemical affinity of each materials combination. The plasma ion cleaning, etching and preheating capabilities would still be effective in improving the bond strength in a manner similar to that of an all-metallic materials combination. The non-metallic materials variation could be effectively applied with the plasma coating process of the invention either in a gas environment or underwater, although the gas environment may be better suited to thermal shock-sensitive material combinations.

An additional variation of the plasma coating process of the invention is to combine both transferred and nontransferred plasma arcs in the same dual-arc torch (or in different torches in close proximity) so that some or all of the improved bonding benefits of the transferred arc can be realized in the same step as the coating application itself. In this configuration the coating non-transferred arc may be adjusted for less than the optimum ion cleaning, etching and preheating, in order to obtain selected powder heating cycles for metallurgical reasons other than improved bonding. Although the equipment requirements may be greater in this dual-arc configuration, the range of useable spray parameters could be increased while maintaining the same or even establishing improved ion cleaning benefits relative to a single arc torch.

The present invention has particular application in noble metal coating of the shroud welds in a BWR. This is achieved by coating the surfaces of the shroud welds and heat affected zones thereof with powder alloy having a noble metal (e.g., palladium) additive. Prior to application of the coating, the surfaces are preferably roughened using ultra high pressure water jets. Selected plasma spray process parameters for underwater application of a noble metal coating on the surface of a BWR shroud are given in Table II.

TABLE II

EXEMPLARY PLANT AND COMPONENT CONDITIONS:

Water Depth - 45 ft (20 psi) minimum
- 75 ft (33 psi) maximum
Water Temperature - 120° F. maximum
Substrate Integrity - uncracked or cracked
Substrate Orientation - vertical or horizontal
Substrate Surface - metallurgically clean, oxide free
Substrate Roughening - UHP water jet (preferred generally)
- nylon with abrasive (acceptable locally)
Substrate Weld Contour* - 2:1 maximum local slope
- ⅛ in. maximum local offset

COATING PHYSICAL CHARACTERISTICS:

Number of Interlayers Per Coating - 3 each
Number of Coatings at Overlap - 2 maximum
Coating Nominal Thickness - 0.002 to 0.008 in.

PLASMA GUN DESIGN FEATURES:

Plasma Gun Consumables - tungsten lined copper anode
- tungsten tipped copper cathode
Anode Size - 8 mm diameter (nominal)
Gas Ring Type - straight holes 8 × 2 mm
Injector Size - 1.50 mm ID × 4.00 mm OD
Injector Quantity - 4 each at 90° apart
Injection Angle - 45° to travel direction

PLASMA GUN SPRAY PARAMETERS:

Arc Ignition Method - underwater RF generator can
Plasma Arc Current - 300 amperes start/idle
- 550 amperes spraying
Arc voltage at Gun Ignition Can - 62 ± 3 volts
Plasma Gas Type - argon + helium (mixed by the system)
Plasma Gas Purity - 99.99% minimum
Argon Flow Rate - 50 SLPM
Helium Flow Rate - 150 SLPM
Cooling Water Flow Rate - 14 LPM minimum
Cooling Water Pressure - 300 psi (nominal)
Cooling Water Temperature - 55° C. maximum

SPRAY POWDER PARAMETERS:

Powder Alloy - ERNiCr-3 (Inconel 82), modified as follows - 0.2 to 1.0% Pd addition; 20.0 to 22.0% Cr range; 0.005% P max.; 0.005% S max.; 0.050% Si max.; 0.020% C max.; 0.020% Co max.; 0.002% B max.; 0.01% N max.; 0.002% Nb max.; minimum(Ta + Nb) = 12 × (% C)
Powder Size - −200/+325 ± 2% U.S. standard mesh (45 to 75 microns nominal size range)
Powder Type - inert gas atomized, spherical shape
Powder Feed Rate - 27.7 g/min (9.0 rpm)
Powder Carrier Gas Type - argon, 99.99% min; purity
Powder Carrier Gas Rate - 12.5 SLPM

GUN MANIPULATOR (ROBOT) PARAMETERS:

Gun Travel Velocity - 6.0 in./sec
Gun Acceleration - 30 in./sec$^2$
Spray Distance - 9/16 + 1/16 in. (preferred)
- ⅝ ± ⅛ in. (acceptable)
Spray Angle - 90° ± 10° (preferred)
- 90° ± 20° (acceptable)

TABLE II-continued

| | |
|---|---|
| Spray Direction | - vertical, up and down, |
| | - horizontal or flat, bidirectional |
| Adjacent Pass Stepover Distance | - 0.20 in. |
| Inter-Layer Pass Offset | - 0.07 in. |

*Spray distance is measured to the substrate local surface, so that all variations (high and low areas) in the local substrate weld contour must be within the specified spray distance range.

The preferred technique for metallurgically bonding a coating to a substrate in accordance with the invention has been disclosed for the purpose of illustration. Variations and modifications of the disclosed technique which fall within the concept of this invention will be readily apparent to persons skilled in the art of thermal spray processes and persons skilled in the art of noble metal technology. For example, a core shroud can be coated with an alloy containing a noble metal different than palladium or containing a mixture of noble metals. All such variations and modifications are intended to be encompassed by the claims set forth hereinafter.

We claim:

1. A plasma spray process for applying a coating on a substrate using a plasma gun, comprising the steps of:

connecting the substrate and a plasma gun power supply to a common ground such that a potential difference exists between the substrate and a cathode of the plasma gun;

arranging the plasma gun such that the plasma gun is directed at a surface of the substrate separated by a distance sufficiently short that a plasma stream exiting the plasma gun during plasma gun operation will impinge directly on the substrate surface;

ion etching the substrate surface by heating the substrate surface with a plasma stream exiting a spray nozzle of the plasma gun to transform oxide-forming atoms on the substrate surface into positive ions, the distance separating said plasma gun and said substrate being such that said positive ions leave the substrate surface under the influence of said potential difference between the substrate and the cathode; and splattering the substrate surface with molten droplets of coating material injected into the plasma gun, wherein said ion etching and said splattering steps are performed concurrently while maintaining said potential difference between the substrate and the cathode.

2. The plasma spray process as defined in claim 1, wherein said ion etching and splattering steps are performed underwater.

3. The plasma spray process as defined in claim 1, wherein said substrate is a portion of a core shroud of a boiling water reactor and said coating is an alloy doped with a noble metal.

4. The plasma spray process as defined in claim 1, further comprising the step of roughening said surface of said substrate prior to application of said coating.

5. The plasma spray process as defined in claim 4, wherein said surface of said substrate is roughened by impacting said surface with a water jet.

6. The plasma spray process as defined in claim 1, wherein said coating has a thickness of 2 to 8 mils.

7. The plasma spray process as defined in claim 1, wherein said substrate is a portion of a core shroud of a boiling water reactor submerged under water and said coating material is an alloy doped with a noble metal.

8. The plasma spray process as defined in claim 1, wherein the distance separating the substrate and the spray nozzle of the plasma gun is ½ to ¾ inch.

9. A plasma spray process for applying a coating on a substrate using a plasma gun, comprising the steps of:

maintaining a potential difference between the substrate and a cathode of the plasma gun, said potential difference having a polarity such that positive ions from the substrate will flow toward the cathode;

cleaning a surface of the substrate by operating the plasma gun under conditions such that positive ions leave the substrate surface and flow toward the cathode under the influence of said potential difference between the substrate and cathode; and splattering the substrate surface with molten droplets of coating material injected into the plasma gun, whereby coating material is metallurgically bonded to the substrate surface, wherein said cleaning and said splattering steps are performed concurrently while maintaining said potential difference between the substrate and the cathode.

10. The plasma spray process as defined in claim 9, wherein said cleaning and splattering steps are performed underwater.

11. The plasma spray process as defined in claim 9, wherein the substrate is a portion of a core shroud of a boiling water reactor and the coating is an alloy doped with a noble metal.

12. The plasma spray process as defined in claim 9, further comprising the step of roughening the surface of the substrate prior to application of the coating.

13. The plasma spray process as defined in claim 12, wherein the surface of the substrate is roughened by impacting the surface with a water jet.

14. The plasma spray process as defined in claim 9, wherein the coating has a thickness of 2 to 8 mils.

15. The plasma spray process as defined in claim 9, wherein the substrate is a portion of a core shroud of a boiling water reactor submerged under water and the coating material is an alloy doped with a noble metal.

16. The plasma spray process as defined in claim 9, wherein the distance separating the substrate and a spray nozzle of the plasma gun is ½ to ¾ inch.

* * * * *